US005829101A

United States Patent [19]

Denz et al.

[11] Patent Number: 5,829,101

[45] Date of Patent: Nov. 3, 1998

[54] FLEECE GUIDANCE SYSTEM WITH LATERAL GUIDANCE IN THE INTAKE AREA

[75] Inventors: Peter Denz, Hohenwart; Alfred Nauthe, Böhmfeld, both of Germany

[73] Assignee: Rieter Ingolstadt Spinnereimaschinenbau AG, Ingolstadt, Germany

[21] Appl. No.: 681,183

[22] Filed: Jul. 22, 1996

[30] Foreign Application Priority Data

Oct. 16, 1995 [DE] Germany ..... 195 38 477.6

[51] Int. Cl.[6] ..... D01H 5/64

[52] U.S. Cl. ..... 19/288; 19/157

[58] Field of Search ..... 19/287, 288, 289, 19/290, 291, 292, 150, 157, 159 R

[56] References Cited

U.S. PATENT DOCUMENTS

| | | | |
|---|---|---|---|
| 614,819 | 11/1898 | Albasini . | |
| 2,640,229 | 6/1953 | Gwaltney | 19/157 |
| 2,996,873 | 8/1961 | Armstrong . | |
| 3,387,339 | 6/1968 | Bofill | 19/288 |
| 3,562,863 | 2/1971 | Fornes | 19/288 |
| 4,372,010 | 2/1983 | Gauvain . | |
| 4,497,089 | 2/1985 | Anahara et al. | 19/288 |
| 4,575,903 | 3/1986 | Gauvain . | |
| 4,763,387 | 8/1988 | Bothner . | |
| 4,922,580 | 5/1990 | Bothner et al. . | |
| 4,949,431 | 8/1990 | Gasser . | |
| 5,016,322 | 5/1991 | Erni et al. . | |
| 5,309,603 | 5/1994 | Oexler et al. | 19/288 |
| 5,412,846 | 5/1995 | Hauner . | |

FOREIGN PATENT DOCUMENTS

| | | |
|---|---|---|
| 593884 | 9/1993 | European Pat. Off. . |
| 801254 | 11/1950 | Germany . |
| 2623400 | 3/1977 | Germany . |
| 290679 | 6/1991 | Germany . |
| 406508 | 3/1934 | United Kingdom . |
| 632266 | 11/1949 | United Kingdom . |
| 786528 | 11/1957 | United Kingdom . |

*Primary Examiner*—Michael A. Neas
*Attorney, Agent, or Firm*—Dority & Manning

[57] ABSTRACT

A fleece guidance system is provided to convey a fiber fleece to the nip of a pair of calendar rollers. The system includes a funnel having a fiber sliver channel defined therethrough which tapers towards an opening adjacent the nip of the calendar rollers. The channel has a longitudinal axis therethrough which is angled relative to a plane through the axes of rotation of the calendar rollers. Oppositely facing guiding segments are configured on the funnel on opposite sides of the opening. The segments have a forward edge which extends into the nip and define lateral guiding surfaces for the fiber sliver exiting from the opening. A plane through the forward edge of the guiding segments and the opening is essentially perpendicular to a plane through the axis of rotation of the calendar rollers.

23 Claims, 2 Drawing Sheets

FLEECE GUIDANCE SYSTEM WITH LATERAL GUIDANCE IN THE INTAKE AREA

BACKGROUND OF THE INVENTION

The technical area of the invention is the fleece guidance system in a machine processing textile fibers, in particular in a draw-frame followed by a calendar. The invention also relates to the replacement part of the sliver funnel which is part of the fleece guidance and is located directly before the calendar disks, in particular in such a manner as to be replaceable. Finally, a process is proposed by means of which the fiber sliver is introduced with lateral guidance into the nip in the above-mentioned sliver guidance system without requiring any adaptation of the calendar disks to different fiber types or fleece qualities.

To explain a conventional fiber fleece guidance system in a machine processing textile fibers, reference is made to the example of EP 593 884 A1. It is shown therein that a sliver funnel is provided in proximity of the calendar disks or rollers, said funnel having a fleece axis which is at an angle relative to the connecting plane of the axes of rotation of the calendar disks. A long fiber sliver channel which is often provided with slits to allow air to escape lets out into the rear outlet area of the sliver funnel. The (collected) fibers fed through the fiber sliver channel are introduced into the tapering funnel area of the sliver funnel, are compressed therein and guided up against one of the rotating calendar disks with its forward end in order to convey the fiber sliver to the nip of the calendar disks where it is calendared. In this conventional design, it is current practice to make the fiber sliver funnel so as to be replaceable and for the width of the calendar disks to be adapted to the textile fiber. In order to obtain guidance of especially fine textile fibers, lateral legs are attached to the sliver funnel at its forward end, extending past the nip beyond the calendar disks. Since the width of the calendar disks can be changed, the width of the above-mentioned legs must be adaptable to the width of the calendar disks, and this is achieved by means of an adjusting washer between the legs (beaks) in order to adapt the width between them to the calendar disks and to fix them at the same time, aligning them at a right angle to the earlier-mentioned connecting plane between the axes of rotation.

OBJECTS AND SUMMARY OF THE INVENTION

The present invention has therefore as a principal object to reduce the adjusting effort of sliver funnels and to facilitate the adjusting tasks provided for the utilization of different fiber materials, or even to dispense with these tasks. Additional objects and advantages of the invention will be set forth in part in the following description, or may be obvious from the description, or may be learned through practice of the invention.

The objects are achieved through the invention in that the fleece guidance system is provided with the above-mentioned funnel insert, but in that this insert is provided at its forward end on both sides of the forward opening with lateral guidance segments. The guidance segments have a central plane which is essentially at a right angle to the previously mentioned connecting plane between the two axes of rotation of the calendar disks in order to guide the fiber sliver precisely in the direction of the nip and to guide the fiber sliver to that location laterally between the calendar disks in the intake zone of said calendar disks.

The guidance is further improved if the guiding segments are made in the form of prongs which adapt themselves to the form of the calendar disks in the intake zone.

In this fleece guidance system it is no longer necessary for lateral guiding segments to extend past the calendar disks and the calendar disks can remain unchanged, whatever the type and quality of the fibers being calendared.

The sliver funnel which is used in the fleece guidance system has the mechanical guiding segments at its forward end where the fiber sliver channel opens and the central plane of the guiding segments are at an angle relative to the axis of the fiber sliver channel. The angle may be from 30° to 60°.

Each of the prongs plays a mechanical guiding role with its inner side in the intake zone of the calendar disks up to the nip. Each prong is provided with a flattened area which is aligned with one calendar disk and is adapted to its form.

Since one prong is provided on each side of the fiber sliver channel outlet, the width (in the direction of the nip) of each prong is less than half the width of the calendar disks. Centered between the calendar disks, the fiber sliver channel extends with its opening in the area of which a mechanical lateral guidance begins.

So that the sliver funnel can be brought close to the calendar nip, it is provided in its central area with a cylinder segment opening to provide room for the rotation of one of the calendar disks and to install the sliver funnel in a tilted position relative to the connecting plane between the rotational axes of the calendar disks so that they can be exchanged, since it is a wear part subjected to greater wear.

Surprisingly, thanks to the above-mentioned lateral guidance of the fiber sliver on the sides of the sliver, the calendar disks no longer need to assume guidance tasks by themselves alone, nor is their width any longer critical since the mechanical guidance is assumed by the sliver funnel precisely as prescribed by the diameter of the forward outlet of the guidance channel. For this reason the process is realized starting at the outlet where the fiber sliver is guided mechanically from four sides and is aligned towards the nip; two of these sides are provided by the rotating calendar disks, the other two sides, at a right angle to the latter, are provided by the mechanical lateral guides, the prongs.

Due to good mechanical guidance from the sides of the sliver funnel it becomes possible, according to the invention, to use only one type of calendar disks. Nevertheless, the fiber sliver being conveyed to the calendar is given better guidance before the nip and into it. The intake of air can be reduced, independently of the width of the calendar disks. At the same time the lateral escaping of fiber sliver in the vicinity of the calendar is blocked. Close adaptation of the mechanical lateral guidance to the form of the calendar disks is especially advantageous here.

It is an independent idea, within the framework of the mechanical lateral guidance, to use the calendar rollers as scanning rollers and to design one of these disks as bing fixed (only rotatable) and the other disk rotatable and capable of movement relative to the fixed disk. In this manner, the thickness of the fiber sliver is scanned in the calendar and can be converted into an electrical signal based on the distance between the movable calendar roller and the fixed calendar disk. According to this idea, it is no longer required to use lateral legs for mechanical guidance, nor is it required that the calendar disks be at a fixed distance from each other, since the mechanical lateral guidance is provided autonomously to a great extent by the prongs which are fixedly positioned at the sides of the sliver funnel.

The prongs may be made in one piece with the sliver funnel.

With the invention the need for legs extending laterally beyond the calendar disks is eliminated and therefore the distance between them need also not be changed to be adapted to the calendar disks in use at the time. Mechanical guidance is ensured in the intake area and is independent of the width of the calendar disks; Nevertheless, the width of the mechanical guidance may be adapted to the width of a special type of calendar disks, but this must be considered as being an exceptional case.

The invention is explained and completed below through several examples of embodiments.

DETAILED DESCRIPTION OF THE PREFERRED EMBODIMENTS

Figure 1:
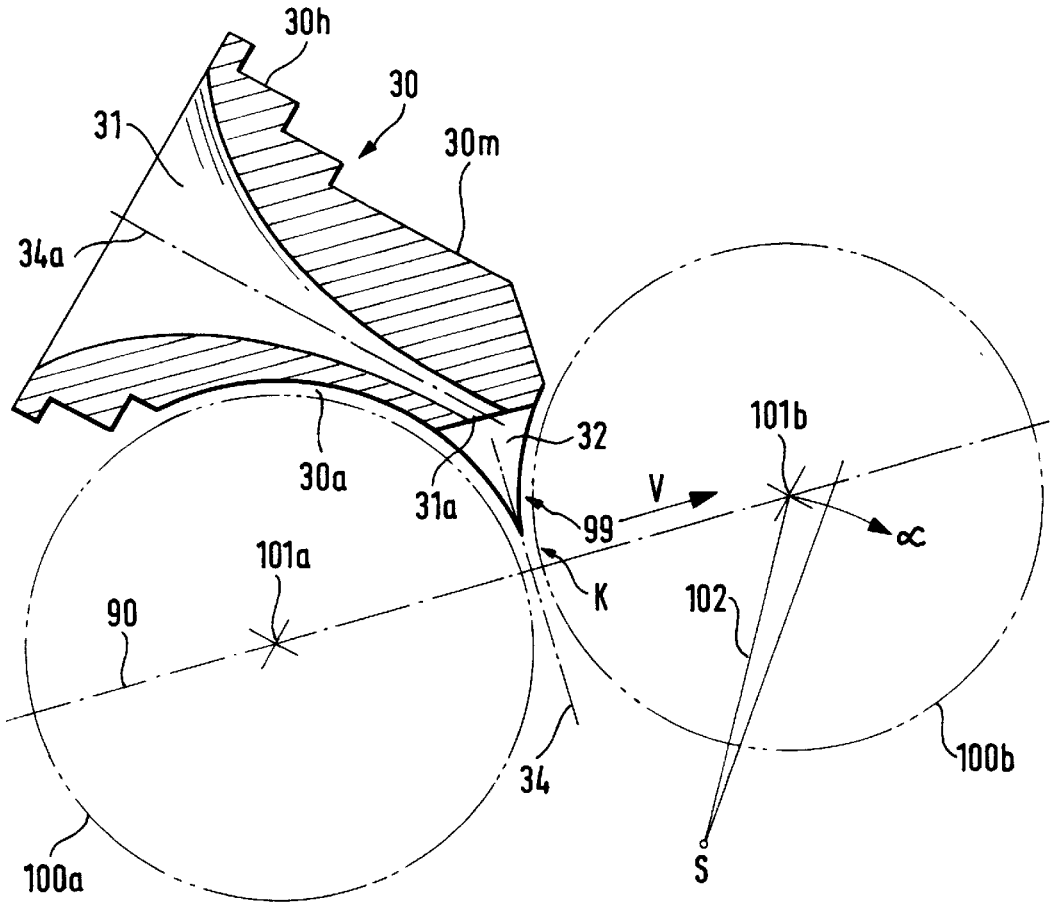
FIG. 1 shows the forward end of a fiber sliver itinerary, without showing the fiber sliver channel. The sliver funnel 30 which extends with a prong zone 32 between the calendar disks 100*a*, 100*b* which define the nip K between them in which the fiber sliver is calendered are shown.

Reference will now be made in detail to the presently preferred embodiments of the invention, one or more examples of which are illustrated in the drawings. Each example is provided by way of explanation of the invention, and not as a limitation of the invention. In fact, features illustrated or described as part of one embodiment can be used on another embodiment to form still a third embodiment. It is intended that the present invention cover such modifications and variations as come within the scope of the appended claims and their equivalents.

FIG. 1 shows the sliver funnel 30 as the forward end of the fleece itinerary which is fed via a sliver guiding channel that is usually provided with air escape slits and is not shown here. It is of the usual configuration. The sliver funnel 30 has a rear section 30*h* (at the rear), a central section 30*m* (center) and a forward area 30*v* (in front) which are clearly shown in FIGS. 2*a* and 2*b*. The rear section is cylindrical and has several cylindrical steps to be inserted in a matching holding device so that it can easily be removed. An inserted sliver funnel 30 is fixed in its position above the calendar disks 100*a*, 100*b* by means of locking screws. The locking screws press down on one of the cylindrical sections 30*a*.

The axis 34*a* of the sliver funnel, which is the central axis of an opening 31 that tapers in the form of a funnel, defines the constricting convergence of the entering fiber sliver. It is usually selected for a particular fiber type and fiber quality, i.e. it is prescribed by technological requirements.

The axis 34*a* of the sliver funnel 30 is at an angle relative to the plane 90 which connects the two axes 101*a* and 101*b* of the calendar disks 100*a*, 100*b*. This plane is generally horizontal, and is slightly inclined in FIG. 1. The plane 90 also contains the nip K through which the fiber sliver must be guided in the direction of the straight line 34 of the drawing, while being calendared (compressed) by the calendar disks 100*a*, 100*b*. The intake area 99 of the calendar is defined between the nip K and the frontal opening 31*a* of the conically tapering sliver funnel opening 31.

Figure 2A:
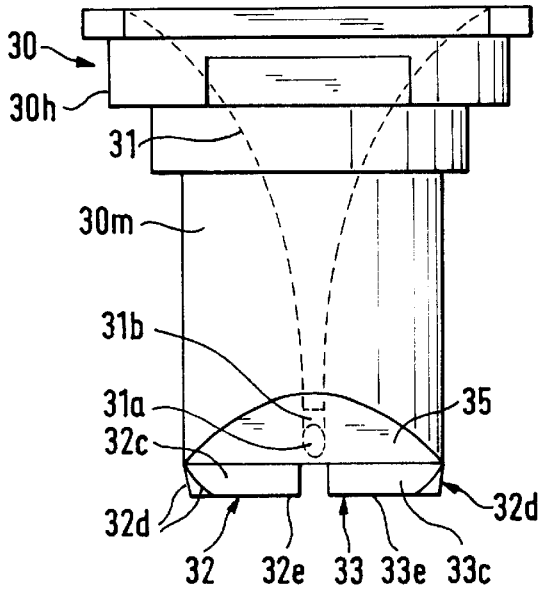
FIGS. 2*a* and 2*b* show two lateral views of the sliver funnel 30 of FIG. 1.
Figure 2B:
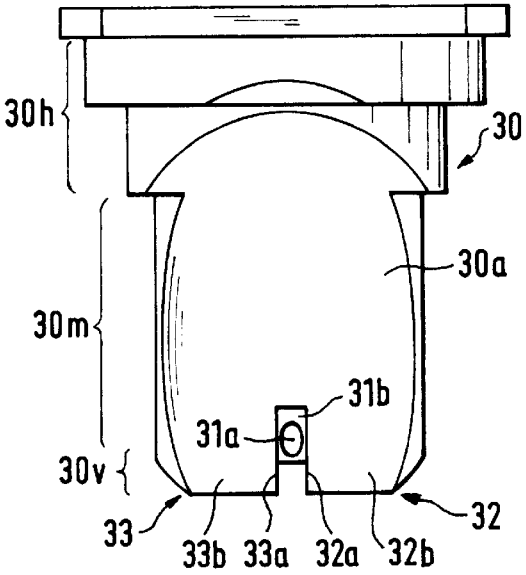
Figure 3:
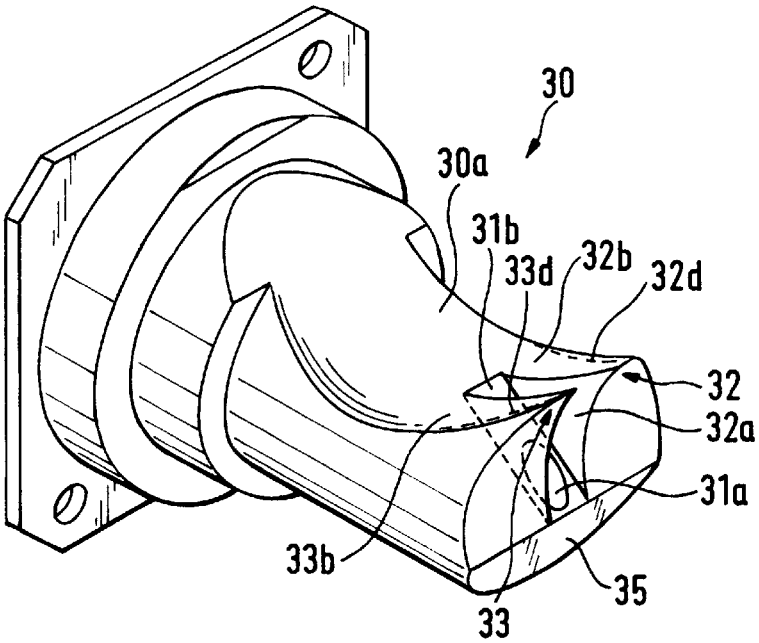
FIGS. 3 and 4 show two perspective views of the sliver funnel 30 according to the FIGS. 2*a* and 2*b* or FIG. 1.

The fiber sliver is introduced along axis 34*a* into the conically tapering opening 31 in the operation of the calendar device and leaves the sliver funnel 30 at the forward opening 31*a* which can also be seen in FIGS. 2*a*, 2*b* and 3. The fiber sliver runs in the direction of the calendar disks, is there deflected by the rotation of these disks and is conveyed in the direction of the nip K. The intake zone 99, which is here described in other words tapers according to the cylindrical form of the calendar disks 100*a*, 100*b*. The direction of sliver movement tends towards the straight line 34 as shown in FIG. 1.

Figure 4:
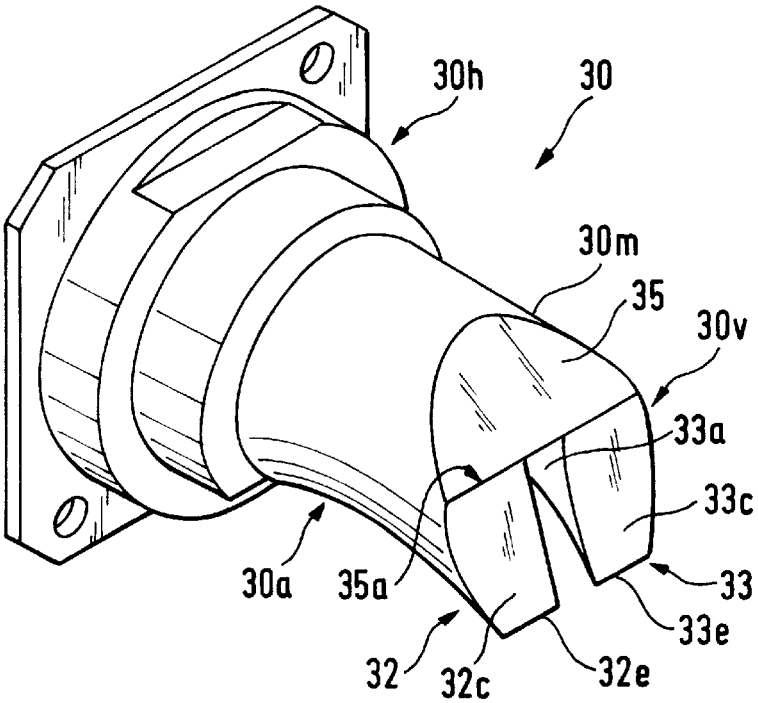

In addition to the guiding system of the calendar disks, a lateral guide is provided as shown in FIG. 1 in the form of a wedge-shaped prong 32 and which can be seen more clearly in a perspective view in FIGS. 3 and 4. The two prongs 32 and 33 are two substantially wedge shaped and tapering guide segments each of which has an inner wall 32*a*, 33*a* starting at both sides of the output opening 31*a* of channel 31. They guide the fiber contact with mechanical contact in the intake area 99 to the nip K without regard to the width of the calendar disks 100*a*, 100*b* and without the presence of lateral guiding assists or locks extending beyond the calendar disks 100*a*, 100*b*. In this manner, the lateral guidance 32*a*, 33*a* is provided in the intake area 99.

The wedge-shaped tapering prongs 32, 33 have flatter areas 32*b*, 32*c* and 33*b*, 33*c* such as shown in FIGS. 2*a* and 2*b*, as well as in FIGS. 3 and 4. These flatter areas are adapted to the form of the calendar rollers so that as close an attribution as possible is provided without any contact between the sliver funnel 30 and the calendar disks.

The wedge-shaped prongs 32, 33 are linear in their forward area, and the corresponding line segments 32*e*, 33*e* can be identified clearly in FIG. 4. Starting at these lines 32*e*, 33*e*, which are as close as possible in front of the nip K, the prongs widen in their outer area towards the rear, towards opening 31*a* in a curved manner 32*d*, 33*d*, whereby it is possible to cause the curvature to depend on which cylindrical part 33*m* which makes up the central area of the sliver funnel 30.

A half-round platform area 35 oriented towards the back starts at an edge 35*a* which is parallel with the nip K and is located on the level of the outlet opening 31*a* of the guiding channel 31 of the sliver funnel 30. It delimits the rear end of the prong-shaped guidance segments 32, 33 and marks the beginning of an approximately rectangular surface 31*b* (visible in FIG. 3) which supports the oval outlet 31*a* of the channel, defined in one direction as being approximately parallel with the plane 90 connecting the axes of rotation 100*a* and 100*b* of the calendar disks. The width of this inclined surface 31*b* is approximately equal to the distance between the inner surfaces 32*a*, 33*a* of the prongs 32, 33 in order to provide the best possible guidance for the emerging fiber sliver.

The straight forward edge 32*e*, 33*e* of the guidance segments 32, 33 (prongs) is shown in FIG. 2*a* in such a manner that it continues backwards at its outer end with two different curvature gradients 32*d* so that the prongs 32, 33 become larger in the rear area than in the area close to the nip K. If the prongs taper to a point, the danger of breakage is higher in the forward area and for this reason care should be taken in practical application that the forward line areas should converge to a point to provide mechanical lateral guidance for the fiber sliver as closely as possible to the nip K for the fiber sliver, but that the extension of the above-mentioned lines 32*e*, 33*e* not be too short so that the prongs are held in the forward area so as to form a line and not resemble arrow points.

A cylindrical opening 30*a* constitutes the prolongation of the prongs 32, 33 on one side of the sliver funnel 30. With this the sliver funnel can be brought into immediate proximity of the nip in that it is "saddled up" on one of the calendar disks without contact. A sliver funnel 30 laid out in this manner defines a guiding axis 34*a* which is at an angle relative to plane 90 as shown most clearly in FIG. 1 with an angle of approximately 45°. The central plane 34 of the guidance segments 32, 33 which are again at an angle relative to the guide axis 34*a* is tangential to the calendar disks in nip K and thereby is perpendicular to the connecting plane 90 of the axis of rotation 100*a*, 100*b* of the calendar disks. The full guidance of the fiber sliver in the funnel area 31 exists as soon as the fiber sliver emerges from opening 31*a* and thus becomes only a bilateral guidance system 32*a*, 33*a* on the inside of the prongs, and the two other lateral guides are provided by the calendar disks so as to form a substantially closed guide in the intake zone 99.

In this manner the fiber sliver, although it leaves the all-around guidance which exists in the fiber guiding channel 31, nevertheless continues to be guided in a mechanically defined manner until it has gone to—and through—the calendar nip K.

The mechanical guidance makes it possible for the width of the calendar disks to be selected independently of the type and quality of the sliver, so that the calendar disks no longer need to be replaced even though the sliver funnel 30 is replaced as a part which is adapted in a modular building-block system to the fiber sliver to be processed.

Because of the mechanical lateral guidance in the intake area 99 towards the nip K, it is possible to enter the position relationship of the calendar disks 100*a*, 100*b* and to make one of these disks, e.g. disk 100*b* as in FIG. 1, so as to be able to change position as could be made possible by a lever arm 102 which is prestressed by being spring-loaded and which swivels the disk 100*b* out by S when the fiber sliver enters the nip K. The swiveling motion provides a measurement of the thickness d(t) and thereby of the mass m(t) of the fiber sliver running through the calendar nip K while lateral guidance by the prongs 32, 33 is maintained.

The above-mentioned movement is shown in FIG. 1 with the angle $\alpha$ by which the rotational axis 101*b* of the calendar disks 100*b* shifts, in a first approximation in a direction of movement V which is in the connecting plane 90. The angle $\alpha$ may however also contain components of which at least one is to extend in direction V while another component may be oriented at a right angle to V, i.e. in direction of axis 34.

The calendar disks 100*a*, 100*b* thus become measured-value indicators which make it possible to determine the thickness and mass of the calendared sliver directly, without requiring an additional measuring device or additional scanning rollers in the outlet area; the fiber sliver may be deposited in a storage area or container directly after the calendar disks., even though its thickness or mass were measured before that.

The devices by means of which the movements of the second calendar disk 100*b* relative to the first calendar disk 100*a* can be measured are conventional devices, and usually a movable target which changes location relative to an inductively measuring distance indicator will be used for this so that the distance between target and distance indicator, and thereby the distance between the movable calendar disk 100 and the calendar disk 100*a* which remains fixed in plane 90, is measured.

It will be apparent to those skilled in the art that various modifications and variations can be made in the present invention without departing from the scope and spirit of the invention. It is intended that the invention cover such modifications and variations as come within the scope of the appended claims and their equivalents.

We claim:

1. A fleece guidance system for use in a fiber processing textile machine in which a fiber fleece is conveyed to a nip of calendar rollers, said system comprising:

a funnel disposable directly upstream of said calendar rollers in a conveying direction of the fiber fleece, said funnel having a fiber sliver channel defined therethrough which tapers towards an opening adjacent said nip of said calendar rollers for compressing the fiber sliver and introducing the fiber sliver to said nip;

said channel having a longitudinal axis therethrough which is at a non-perpendicular angle relative to a plane through axes of rotation of said calendar rollers;

oppositely facing guiding segments integrally formed on said funnel on opposite sides of said opening, said guiding segments having a forward edge extending into said nip and defining lateral guiding surfaces for the fiber sliver exiting said opening so that a plane through said forward edge and said opening is essentially perpendicular to said plane through said axes of rotation of said calendar rollers; and wherein said guiding segments cooperate with said calendar rollers to define a guidance channel for the fiber sliver exiting said opening and conveyed into said nip.

2. The system as in claim 1, wherein said guiding segments comprise prongs defined by contours which generally match the curvature of said calendar rollers so that said prongs generally conform to the shape of an inlet zone defined by said calendar rollers leading to said nip.

3. The system as in claim 1, wherein said forward edges of said guiding segments converge in an arc shape and extend in a generally straight line parallel to said plane through said axes of rotation of said calendar rollers.

4. The system as in claim 1, wherein said guiding segments comprise oppositely facing inner surfaces directly adjacent said opening and having a generally wedge shape.

5. The system as in claim 4, wherein said guiding segments have a maximum width directly adjacent said opening that is less than half of the width of said calendar rollers.

6. The system as in claim 1, wherein said plane through said forward edge and said opening forms an angle of generally between thirty and sixty degrees with said longitudinal axis through said fiber sliver channel.

7. The system as in claim 1, wherein said guiding segments comprise oppositely facing inner surfaces directly adjacent said opening and spaced apart a distance less than the width of said calendar rollers.

8. The system as in claim 1, wherein said funnel is a replaceable component and comprises means for being removably inserted in said fleece guidance system.

9. The system as in claim 8, wherein said funnel comprises a generally cylindrical rear insert section with stepped surfaces for variable attachment in said textile machine, and a generally cylindrical central segment.

10. A sliver funnel for use in a fiber sliver textile processing machine wherein a fiber sliver is introduced into a nip defined by a pair of calendar rollers, said funnel comprising a fiber sliver channel defined therethrough which tapers toward an opening disposable adjacent said nip of said calendar rollers for compressing the fiber sliver and introducing the fiber sliver to said nip; said channel having a longitudinal axis therethrough which is at a non-perpendicular angle relative to a plane through axes of rotation of said calendar rollers when said funnel is installed in said textile machine; oppositely facing guiding segments integrally formed on said funnel on opposite sides of said opening, said guiding segments having a forward edge configured to extend into said nip and define lateral guiding surfaces for the fiber sliver exiting said opening so that a plane through said forward edge and said opening is essentially perpendicular to said plane through said axes of rotation of said calendar rollers; and wherein said guiding segments cooperate with said calendar rollers to define a guidance channel for the fiber sliver exiting said opening and conveyed into said nip.

11. The sliver funnel as in claim 10, wherein said guiding segments comprise prongs defined by contours which generally match the curvature of said calendar rollers so that said prongs generally conform to the shape of an inlet zone defined by said calendar rollers leading to said nip.

12. The sliver funnel as in claim 10, wherein said forward edges of said guiding segments converge in an arc shape and extend in a generally straight line parallel to said axes of rotation of said calendar rollers when said funnel is installed in said textile machine.

13. The sliver funnel as in claim 10, wherein said guiding segments comprise oppositely facing inner surfaces directly adjacent said opening and having a generally wedge shape.

14. The sliver funnel as in claim 10, wherein said plane through said forward edge and said opening forms an angle of generally between thirty and sixty degrees with said longitudinal axis through said fiber sliver channel.

15. The sliver funnel as in claim 10, wherein said funnel is a replaceable component and comprises means for being removably inserted into a fiber sliver textile processing machine.

16. The sliver funnel as in claim 15, wherein said funnel comprises a generally cylindrical rear insert section with stepped surfaces for variable attachment in said textile machine, and a generally cylindrical central segment.

17. A fiber sliver textile processing machine, comprising:

a pair of calendar rollers for calendaring a fiber sliver delivered to a nip defined by said calendar rollers or disks;

a fleece guidance system for conveying a fiber fleece to said nip, said fleece guidance system comprising;

a funnel disposable directly upstream of said calendar rollers in a conveying direction of the fiber fleece, said funnel having a fiber sliver channel defined therethrough which tapers toward an opening adjacent said nip of said calendar rollers for compressing the fiber sliver and introducing the fiber sliver to said nip;

said channel having a longitudinal axis therethrough which is at a non-perpendicular angle relative to a plane through axes of rotation of said calendar rollers;

oppositely facing guiding segments integrally formed on said funnel on opposite sides of said opening, said guiding segments having a forward edge extending into said nip and defining lateral guiding surfaces for the fiber sliver exiting said opening so that a plane through said forward edge and said opening is essentially perpendicular to said plane through said axes of rotation of said calendar rollers; and wherein said guiding segments cooperate with said calendar rollers to define a guidance channel for the fiber sliver exiting said opening and conveyed into said nip.

18. The textile machine as in claim 17, wherein said guiding segments comprise prongs defined by contours which generally match the curvature of said calendar rollers so that said prongs generally conform to the shape of an inlet zone defined by said calendar rollers leading to said nip.

19. The textile machine as in claim 17, wherein said guiding segments comprise oppositely facing inner surfaces directly adjacent said opening and having a generally wedge shape.

20. The textile machine as in claim 19, wherein said guiding segments have a maximum width directly adjacent said opening that is less than half of the width of said calendar rollers.

21. The textile machine as in claim 17, wherein said plane through said forward edge and said opening forms an angle of generally between thirty and sixty degrees with said longitudinal axis through said fiber sliver channel.

22. The textile machine as in claim 17, wherein said guiding segments comprise oppositely facing inner surfaces directly adjacent said opening and spaced apart a distance less than the width of said calendar rollers.

23. The textile machine as in claim 17, wherein one of said calendar rollers comprises means for being displaced in response to changes in thickness of the fiber sliver conveyed through said nip, said machine further comprising a means configured with said displaceable calendar roller for sensing said thickness of said fiber sliver.

* * * * *